US006874190B2

(12) United States Patent
Deflander et al.

(10) Patent No.: US 6,874,190 B2
(45) Date of Patent: Apr. 5, 2005

(54) HAND-HELD CONTAINER

(75) Inventors: Joseph Fernand Deflander, Espelaar (BE); Jacky Pierre Duquet, Herbeville (FR); Kirk Wallace Lake, West Chester, OH (US); Greet Renée Els Francine Notele, Hoboken (BE)

(73) Assignee: The Procter & Gamble Company, Cincinnati, OH (US)

( * ) Notice: Subject to any disclaimer, the term of this patent is extended or adjusted under 35 U.S.C. 154(b) by 130 days.

(21) Appl. No.: 10/041,167

(22) Filed: Jan. 8, 2002

(65) Prior Publication Data

US 2002/0056165 A1 May 16, 2002

(30) Foreign Application Priority Data

Jul. 27, 1999 (EP) ..... 99870166

(51) Int. Cl.[7] ..... D06F 39/02

(52) U.S. Cl. ..... 8/158; 68/207; 68/213; 68/17 R; 206/0.5

(58) Field of Search ..... 68/17 R, 5 A, 68/207, 213, 235 R, 223; 206/0.5; 510/277, 439; 222/212, 463; 8/158

(56) References Cited

U.S. PATENT DOCUMENTS 2,956,709 A * 10/1960 Morris et al. ..... 222/129
T99,001 * 1/1980 Mccrathy
4,703,872 A * 11/1987 Cornette et al. ..... 222/158
4,835,804 A * 6/1989 Arnau-Munoz et al. ..... 8/158
4,915,267 A * 4/1990 Buecheler et al. ..... 222/463
4,944,165 A * 7/1990 Leebeek et al. ..... 68/17 R
4,969,927 A * 11/1990 Schumann et al. ..... 8/159
5,033,643 A * 7/1991 Schumacher ..... 222/52
5,129,120 A * 7/1992 Cornette et al. ..... 8/158
5,355,541 A * 10/1994 Rutter et al. ..... 8/158
5,388,298 A * 2/1995 Rutter et al. ..... 8/158
5,425,253 A * 6/1995 Rizzo ..... 68/17 R
5,678,917 A * 10/1997 Bergkvist ..... 362/84
5,877,753 A * 3/1999 Takenaka ..... 345/551
5,918,487 A * 7/1999 Franceus ..... 68/235 R
5,924,151 A * 7/1999 Connan ..... 8/158
6,032,495 A * 3/2000 Leu ..... 68/17 R
6,095,380 A * 8/2000 Fagg et al. ..... 222/463
6,213,665 B1 * 4/2001 Degoix et al. ..... 401/209
6,233,771 B1 * 5/2001 Hortel et al. ..... 8/150
6,301,733 B1 * 10/2001 Dawson et al. ..... 8/158
6,523,371 B1 * 2/2003 Sherratt et al. ..... 68/17 R
6,574,883 B2 * 6/2003 Giblin et al. ..... 34/90

* cited by examiner

*Primary Examiner*—Frankie L. Stinson
(74) *Attorney, Agent, or Firm*—Jeffrey V. Bamber; Armina E. Matthews; Kim William Zerby

(57) ABSTRACT

A process for washing laundry using a hand-held container having a mixing volume, friction means and dispensing means, the process comprising a first step of preparing a mixture by inserting a detergent composition and water in the mixing volume, a second step of cleaning the laundry by dispensing at least part of the mixture onto the laundry and by scrubbing the laundry with the friction means, the process being characterized in that the second step is directly followed by a rinsing step.

10 Claims, 6 Drawing Sheets

HAND-HELD CONTAINER

TECHNICAL FIELD

The invention relates generally to the washing of laundry.

BACKGROUND OF THE INVENTION

Laundry is traditionally washed in two main ways: by hand or by machine. Both hand laundry wash and machine laundry wash have advantages and disadvantages. Indeed, machine laundry wash is practical in that it requires minimum effort. Alternatively, hand laundry wash requires significant effort, but does not require buying a washing machine or having infrastructures such as sufficient electric and water supply allowing use of a washing machine.

The invention seeks to provide a process for washing laundry, whereby the effort to clean laundry is reduced when compared to traditional hand wash, and whereby there is no need for a washing machine or for the infrastructures needed for a washing machine.

SUMMARY OF THE INVENTION

In accordance with a first aspect of the invention, this is accomplished in a process for washing laundry using a hand-held container having a mixing volume, friction means and dispensing means, the process comprising a first step of preparing a mixture by inserting a detergent composition and water in the mixing volume, a second step of cleaning the laundry by dispensing at least part of the mixture onto the laundry and by scrubbing the laundry with the friction means, the process being characterised in that the second step is directly followed by a rinsing step.

In accordance with a second aspect of the invention, this is accomplished in a kit comprising a hand-held container and instructions, the hand-held container having a mixing volume, friction means and dispensing means, and the instruction describing a process for washing laundry using the hand-held container, the process comprising a first step of preparing a mixture by inserting a detergent composition and water in the mixing volume and a second step of cleaning the laundry by dispensing at least part of the mixture onto the laundry and by scrubbing the laundry with the friction means.

In accordance with a third aspect of the invention, this is accomplished in a kit comprising a hand-held container and a washboard, the hand-held container having a mixing volume, friction means and dispensing means.

Laundry washing according to the invention has a number of advantages. The hand-held container provides both the friction means and the product supply, whereby the mixture may be supplied in a progressive and continuous manner during use of the friction means without need for extra operations. Furthermore, such a container may be a one-piece container which is simple to produce. Since the hand-held container has a mixing volume and since the mixing volume serves for mixing the detergent and the water, the container can be used for applying not only liquid detergent, but also for example powder or granular detergents dissolved in water.

BRIEF DESCRIPTION OF THE DRAWINGS

The invention will now be described by way of example and with reference to the accompanying drawings in which.

DETAILED DESCRIPTION OF THE INVENTION

Figure 1:
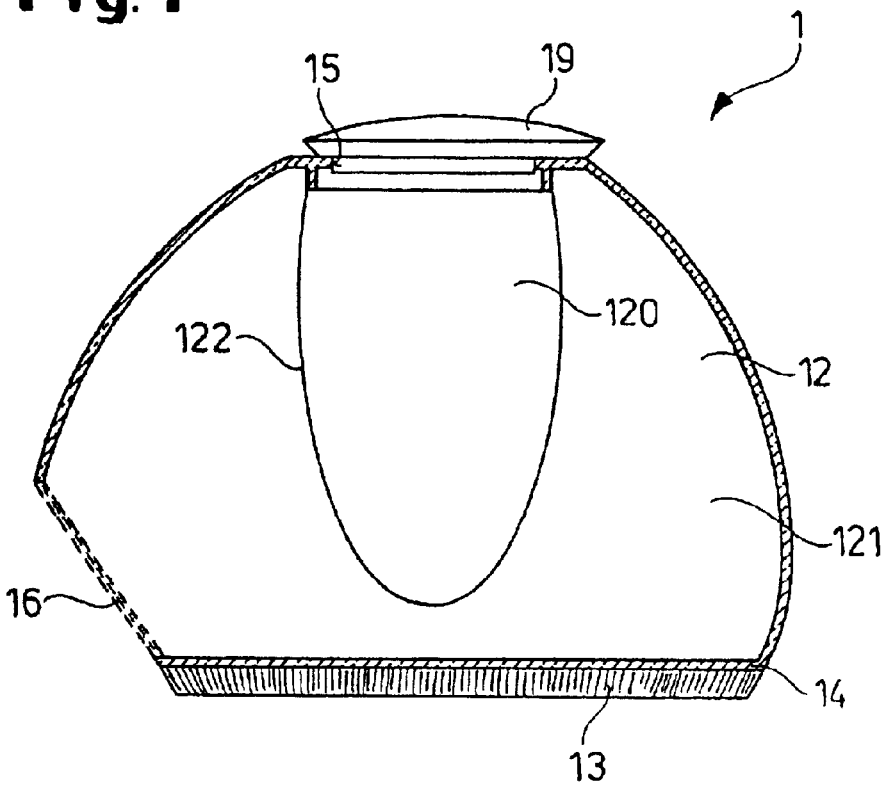
FIG. 1 is a cross section of an embodiment of a hand-held container according to the invention.

The invention relates to a process for washing laundry using a mixture of a detergent composition and water. The detergent composition may have various forms, including liquid, gel, powder, paste, granular or readily dosed forms such as unit doses of flowing material or tablets. Furthermore, the detergent composition may be comprising several of these form. Preferably, the detergent composition are flowing materials, whereby they are in a form which allows flowing under gravity, as do for example the liquid or the granular forms.

The mixture is applied to laundry. Application can occur in various ways, such as pouring or discharging and preferably involves mechanical action such as scrubbing, wiping, scratching or rubbing.

The invention relates to a hand-held container. By a hand-held container, it should be understood that it can be held by hand. However, it does not have to be used by hand. This container has a mixing volume. The mixing volume is the volume in which the mixture can be found. The mixing volume may be partially or completely full of the mixture. If the mixture is filling only part of the mixing volume, the remainder may be air for example. It should be noted that partial filling would allow leaving part of the volume filled with air, thus aiding during shaking. This could be encouraged by means of a dosing line for example. The mixing volume is preferably but not necessarily formed of a hollow body. Indeed, other forms for the mixing volumes may be used, such as a puff having an internal pocket and surrounding extensions, whereby both the pocket and the extensions are forming the mixing volume. It should be noted that the mixing volume does not necessarily have an homogeneous structure. Indeed, it may be formed from a hollow body together with a part defining a plurality of inter-linked channels or cavities such as a sponge medium or a foamed plastic medium or of two of these media. As the mixing volume is for forming a mixture, if it comprise several chambers, such chambers will be inter-linked. As mentioned earlier, the mixing volume may be defined by a pocket having extensions, whereby the pocket and the extensions are made of material forming a net-like structure. Such a structure may be provided with a soft porous pouch for covering it in order to control dispensing and to avoid catching extensions during machine use. The mixing volumes can be adapted and designed to have an influence on the mixture. For example, it may have a structure favouring or preventing dissolution, by separating or by having means for mixing the products forming the mixture. Such mixing means include having an object such as ball for example or a plurality of balls within the mixing volume for improving mixing by means of mechanical action, whereby the balls may have various shapes including spherical and various surfaces including spiky surfaces. Dissolution may also be favoured by static parts projecting into the mixing volume. Other mixing means include having a sieve, sifter or propeller axis within the mixing volume, whereby the sieve, sifter or propeller axis may be mobile or articulated. The hand-held container according to the invention further comprises friction means. Such friction means are allowing active mechanical treatment of the surface in combination with the applied mixture. A reason for having such friction means can be to improve cleaning efficiency. Such friction means should co-operate with the surface to be treated. In order to achieve this, the friction means may be rougher for hard surface use, or softer for other surfaces. The aim is to have efficient treatment of the surface while avoiding to damage the surface to treat. Such a friction means includes a net structure. Such a net is typically made of relatively abrasive woven fibres.

The process of the invention has a first step whereby a mixture is prepared by inserting a detergent composition and water in the mixing volume. It should be noted that insertion is not necessarily simultaneous. The detergent composition is preferably inserted firstly and the water subsequently. Furthermore, insertion may or may not be continuous or repeated. Indeed, insertion may occur at once. Additionally, the detergent composition and/or water may not be inserted in the same manner. Indeed, the detergent composition may for example be inserted through an opening directly within the mixing volume, whereas the water may for example be inserted through a porous membrane. Insertion may be facilitated by various means. For example, the container may comprises flexible resilient walls which could allow creation of a pressure gradient between a part or whole of the mixing volume and the surrounding environment, so that the water, for example, could be sucked in the mixing volume by means of pressure depression, for example through a porous membrane. Once inserted within the mixing volume, the mixture is formed. It should be noted that the mixture may not be homogeneous, and it is possible that some of the detergent composition forming the mixture are not miscible. The term "mixture" as used in the invention could relate to a mere grouping of products which may not mix. However, there is at least water and a detergent composition forming the mixture, these two elements being at least partially present in the mixing volume, even if not mixing.

The process according to the invention has a second step whereby at least part of the mixture is dispensed or applied to the laundry and the friction means are used for scrubbing the laundry. By at least part of the mixture, it is meant that the mixture is not necessarily applied to the laundry completely. Indeed, part of the mixture may be kept for other purposes, as for a subsequent use for example. The part of the mixture which is applied to the surface may be applied continuously or discretely, in one go or repeatedly. Indeed, the hand-held container may comprise means for controlling delivery of the mixture to the surface, whereby such controlling means may control the quantity or the form of the mixture delivered to the laundry or both. Such controlling means include for example flexible resilient walls, whereby depression of these could create a pressure gradient favouring egress of the mixture, the action on these walls also possibly allowing control of the form of the mixture to dispense by allowing to have a mechanical action on the content of the mixing volume, which can result in an improvement in dissolution of the detergent composition in the water, for example. Indeed, in a preferred embodiment according to the invention, the detergent composition is formed from granules. In another preferred embodiment, dispensing is obtained by repeatedly pressing onto a flexible and resilient dome placed on the part of the hand-held container opposite to the part comprising friction means. Such an embodiment, as well as others, is advantageously combined with use of a valve, such as a self seal valve for example which will provide the dispensing, such a self-seal valve opening preferably in the part of the hand-held container comprising the friction means, and such self-seal valve opening when the mixing volume is submitted to sufficient pressure, such sufficient pressure being for example obtained by pressing onto the dome as mentioned above. Indeed, a self-seal valve is typically comprising a slit which opens under a defined pressure threshold. The second step also mentions use of the friction means. Such use of the friction means may be concomitant or not with the application of the mixture. Other types of valve may also be considered.

Preferably, a device according to the invention has a relatively compact structure with a minimal number of extensions, in order to facilitate handling by the user.

The process according to the invention could comprise an extra step. This extra step would consist in applying water directly to the surface prior to the second step. Indeed, laundry should preferably be firstly wet with water.

The water may be inserted in the hand-held container by dipping or immersing in water, partially or completely, in such a manner that some of the water will enter the mixing volume. In another manner, the hand-held container is laid onto the surface on which the water has already been applied directly, so that some of the water may enter the mixing volume. Use of the hand-held implement for such a hand washing process is allowing to use a minimal quantity of either the detergent composition or water, particularly compared to quantities required for machine wash. Indeed, as the mixture is within the mixing volume, it can be dispensed in a controlled manner. This differs also from existing hand washing processes, whereby a bar of soap is directly rubbed onto the surface to wash, or whereby the surface to wash is completely immersed in a mixture. Indeed, the bar soap method requires repeated wetting of the surface in order to dissolve the soap, whereas according to the invention, pre-dissolution can occur within the mixing volume. Furthermore, a bar soap will reduce in shape during use, so that direct use will be rendered awkward and uncomfortable after a certain number of uses, to the difference with the hand-held container according to the invention. Complete immersion hand-wash is particularly product consuming as a large quantity of mixture is prepared for complete immersion of the surface within the mixture. Furthermore, complete immersion still often requires mechanical action, i.e.

friction, to obtain a satisfactory result, whereby the user of such process often has to insert the hands into the mixture, which may be of concern if the mixture has an effect on the skin. Indeed it is believed that the process of the invention allows product economy, and therefore benefits to the environment, while allowing satisfactory use.

Preferably, the mixing volume is provided with at least one filling opening in order to place or pour the content within the volume. When used in the process according to the invention, the filling opening could be used for inserting either or both of the detergent composition or water. It should be noted that more than one opening could also be provided. For example, a first opening could allow insertion of the detergent composition and a second opening of the water. Indeed, the detergent composition and the water intended to be inserted in the container could for example have different forms, as the detergent composition could be a tablet, granules or a liquid for example, whereby use of different openings having different characteristics more particularly adapted to the insertion of a given form would be preferable. Indeed, the filling opening could have a shape or contour varying greatly. However, in a preferred embodiment according to the invention, the filling opening has a circular contour. It should also be noted that the filling opening could co-operate with a cap allowing repeated closure of the opening. Typically, such a hand-held container is provided with means for the distribution of the content. The means for distribution may be of various kinds. Indeed, such means of distribution may simply be provided by the filling opening, but they may also be provided by extra means. Indeed, the container according to the invention may be provided with a porous membrane for example, whereby the porous membrane allows dispensing the content of the device. The device could also be provided with one or with a plurality of extra openings for this purpose. Such openings could also be valves, thus having a closed and an opened position. One or more self-seal valves could be used as mentioned above.

According to the invention, the process is directly followed by a rinsing step. Indeed, the hand-held container is for use as a laundry washing implement, in that it replaces use of a washing machine for example. This differs from pre-treating device used to pre-treat laundry prior to a machine wash. Therefore, once the laundry has been cleaned using the hand-held container, the laundry should be rinsed in water and thereafter dried, so that the whole of the wash cycle is accomplished without need for a washing machine. Preferably rinse is obtained by passing the cleaned laundry in water which is free from detergent composition. It should be noted that the hand-held device may be used for rinsing by filling the mixing volume with water only. This further reduces the quantity of water needed for the whole wash process, particularly in comparison with machine washing.

In a preferred embodiment, the laundry is allowed to soak prior to the step of cleaning the laundry. Indeed, it was found that soaking is facilitating the laundry process further. Soaking may take place simply in water or in water containing a detergent composition. It should be noted that the laundry may also be allowed to soak after the second step. In case of soaking after the second step and before the rinse, soaking is considered as a passive part, so that the second step is still considered to be directly followed by the rinsing step. However, a sequence such that machine wash takes place after the second step and before rinsing would be such that the second step would not be directly followed by rinsing.

The process is further facilitated by selectively scrubbing the dirty or stained part or parts of the laundry. This advantageously combines with soaking as described above. Considering that such a process of laundry wash is unusual, the invention relates to a kit comprising a hand-held container as well as instruction, the hand-held container having a mixing volume, friction means and dispensing means, and the instruction describing a process for washing laundry using the hand-held container, the process comprising a first step of preparing a mixture by inserting a detergent composition and water in the mixing volume and a second step of cleaning the laundry by dispensing at least part of the mixture onto the laundry and by scrubbing the laundry with the friction means. Such instruction allow the user to benefit fully from the advantages of the device as mentioned in the present document. These instruction may mention further optional steps of the process or other type of information such as for example disclosed in the present document. Such instruction may be provided in various ways including printing directly on the device, or may be printed onto a leaflet provided with the device, or may also be printed onto a package for the device. Such instruction would advantageously be in the graphic form or comprise graphics, particularly to facilitate understanding by the user.

In a further aspect, the invention provided a kit comprising a hand-held container having a mixing volume, friction means and dispensing means, the kit comprising a washboard. Indeed, such a kit allows the user to be fully equipped to benefit from the invention. Such a kit may be used in a process comprising a first step of preparing a mixture by inserting a detergent composition and water in the mixing volume and a second step of cleaning the laundry by dispensing at least part of the mixture onto the laundry and by scrubbing the laundry with the friction means, the laundry being placed between the hand-held container and the washboard. Such a kit may also comprise instructions. In a most preferred embodiment, the washboard has a surface which co-operates to a certain degree with the friction means of the hand-held container. Such co-operation may for example be obtained by having corrugations on the washboard surface, the friction means the hand-held device having a shape mating the corrugations, such that the scrubbing occurs preferably in the same direction as the corrugations.

The hand-held container according to the invention preferably has a base at one end. By a base, it should be understood that the device has supporting means. Indeed, a base would allow to support the hand-held container in a stable manner when the hand-held container is laid onto a surface. There is different reasons for which the hand-held container according to the invention preferably has a base. Firstly, as the hand-held container is intended for use in washing laundry, it should preferably be suitable for dosing a cleaning composition. In order to achieve dosing, the device should be stable on its base while pouring or placing the cleaning composition in. The filling opening could for example be used for pouring or placing the content of the device in order to dose it. Secondly, as the device according to the invention is intended for laundry wash, it should be provided with a substantial contact with the surface to be treated. It is indeed a preferred feature of the hand-held container according to the invention that it has friction means situated on the outer surface of the base, the friction means having a length along one direction of at least 4 cm. An important criteria is that while moving the hand-held container on the laundry to be washed in the same manner as one would when using for example a soap bar, the active part of the hand-held container, in other words the friction means, is defining a band along the trajectory of the hand-held container on the laundry to be washed whereby the band has a sufficient surface allowing complete coverage in a sufficient time. Indeed, the other dispensing devices having friction means are adapted for pre-treatment and are therefore having friction means defining a surface or band of application along the trajectory of the device on the surface which has a width of the order of 1 cm, so that an extensive use of such friction means would require a long time, thus prohibiting use of such existing devices for use as normal hand washing of clothes for example. Indeed the hand-held container according to the invention is suitable for use as a hand wash device. It has a friction means allowing an improvement in efficiency of hand wash by having a length along one direction of at least 4 cm, so that a band described by the friction means on the surface to be treated along the trajectory of the device would have a width of 4 cm. This is the case when the device is used in such a manner that the trajectory is in a direction substantially perpendicular to the length of at least 4 cm. Such a length indeed corresponds to the typical width of a soap bar, such bars being typically used for such extensive hand washing operations. In this manner, the friction means could for example consist in a linear brush having the required length, thus rendering hand wash particularly efficient when the trajectory of the device is perpendicular to the direction of the brush. The friction means could also be a succession of such linear brushes or could cover a whole surface having at least one dimension of at least 4 cm. It should be noted that such a 4 cm length could be achieved using a plurality of portions of a shorter length which would still describe a band having a width of at least 4 cm. Furthermore, such a 4 cm length could be achieved by a plurality of portions at an angle from each other such that the band described during use would have a width of at least 4 cm. Even more preferably, the friction means are having a length along one direction of at least 4.5 cm. Most preferably, the friction means are having a length along one direction of at least 5 cm. To note, the hand-held device may also be used in a manner different from a soap bar, i.e. by scrubbing in a manner different than one would with a soap bar.

Figure 2:
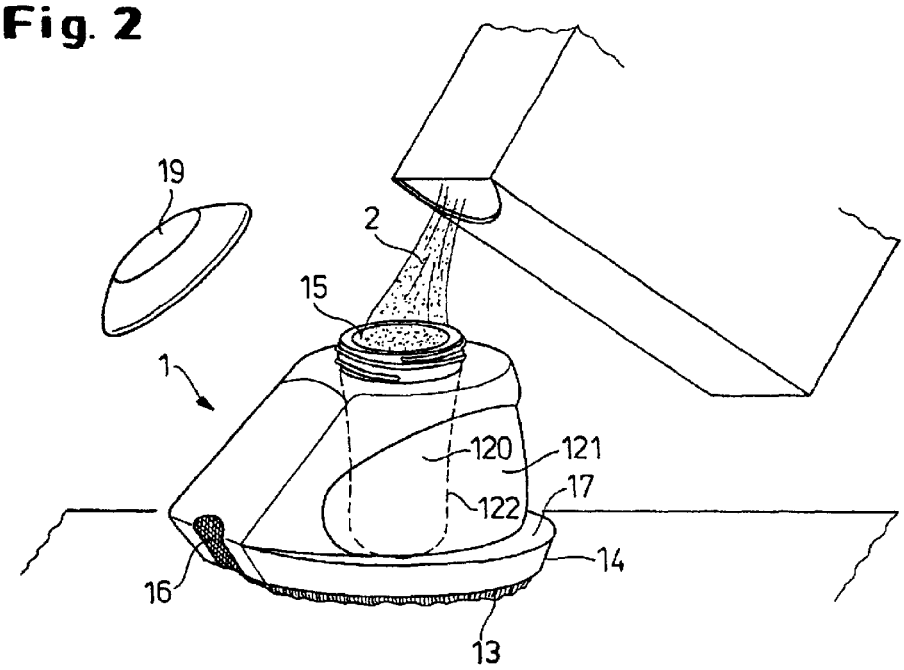
FIG. 2 is a perspective view of the hand-held container of FIG. 1 during the first step of the process of the invention.
Figure 3:
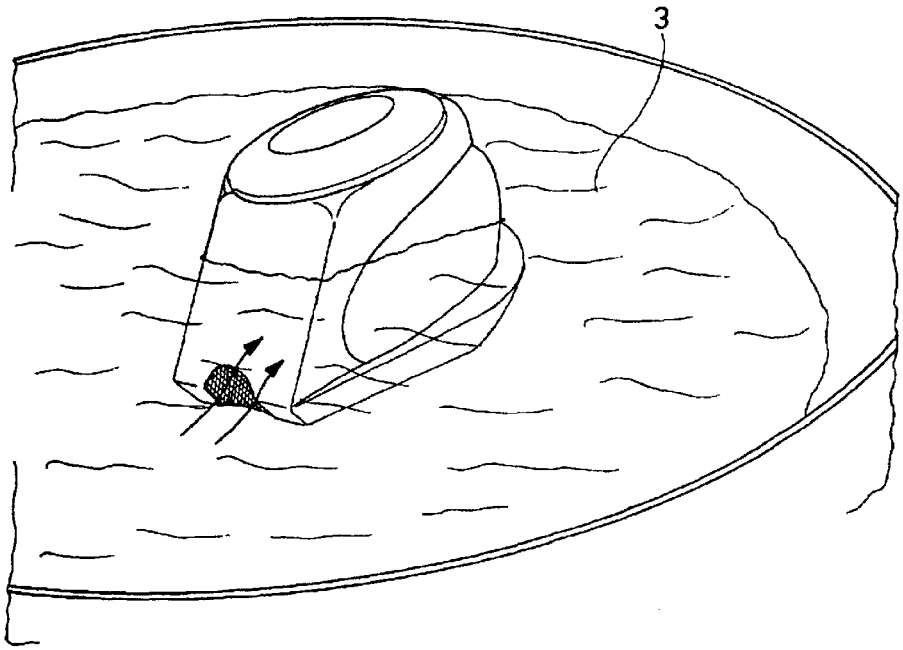
FIG. 3 is a perspective view of the hand-held container of FIG. 1 during the first step of the process of the invention.

A first embodiment of a hand-held container according to the invention is presented on FIG. 1. In this embodiment, the volume 12 defined for the content is consisting in a hollow body. In this particular example the volume 12 is divided in two parts by a porous membrane 122, but such a membrane 122 is not necessary. The membrane 122 is defining two media which it separates. The object of such media is to control the mixture of the detergent composition and of the water which may be inserted according to the process of the invention. For example, when using this device or hand-held container for the process of the invention, the detergent composition 2 can be inserted through a filling opening 15 within the first medium 120, the water 3 being inserted in the second medium 121 through a second opening 16. As the membrane is porous 122, the water and the detergent composition will start mixing. However, mixing will not occur as fast as it would if the membrane 122 was not present. In a preferred example, the detergent composition 2 is a cleaning composition preferably in the form of granules, gel, liquid or in the tablet form, while the water 3 is a solvent for the detergent composition 2. In this example, if the detergent composition 2 is a detergent composition in the granular form, it will be poured through the first filling 15 opening to fill into the first medium 120 as shown on FIG. 2, and water 3 is inserted in the second medium 121, by dipping the device 1 in a bucket of water for example, as shown in FIG. 3. It should be noted that this embodiment of the device 1 is further comprising a lid 19 co-operating with the first filling 15 opening to allow closure. Once both products, i.e. the water and the detergent composition, are being inserted, the detergent composition 2 and the water 3 come into contact through the porous membrane 122. In this example, the membrane 122 is sufficiently porous to freely let water through, whereas the granules are being kept within the first medium 120. This can be obtained by using a membrane 122 made from a net having a hole size smaller than the size of the granules for example. As the water is acting as a solvent for the detergent composition, the first product 2 will start dissolving, so that the first product 2 in the dissolved form will enter the second medium 121 which was already containing the second product 3. The advantage of such a two media system is that it allows progressive dissolution, this having several advantages. Firstly, progressive dissolution allows use of the device for a longer time, which is a significant advantage in case of extensive hand washing. Another advantage of progressive dissolution appears if the first product is containing sensitive components. This particularly applies to a mixture of enzymes and of bleaching components, whereby bleaching components are active for a limited period once dissolved in an environment comprising enzymes. In such a case, progressive dissolution allows to keep part of the sensitive component such as the bleaching components in a "dry" or protected state so that the dispensing device can be effectively used during a time longer than the limited period of activity of the sensitive component. Indeed, if dissolution occurred at once, all of the active components would be active from the start, and would stop being active once the device has been used for the period of activity of these components. In the case of bleaching components, the period of activity is of the order of 10 minutes, after which the activity drops significantly in the presence of enzymes. If using a device with progressive dissolution, bleaching components will be activated progressively, thus progressively replacing the bleaching components which are not anymore effective, therefore allowing to use efficiently the device for a longer time. It should be noted that such progressive dissolution may be obtained by other means, even in the absence of a two media system, for example by controlling the quantity of water relative to the quantity of detergent solution, or by shaking more or less the hand-held container to allow for more or less dissolution.

Figure 4:
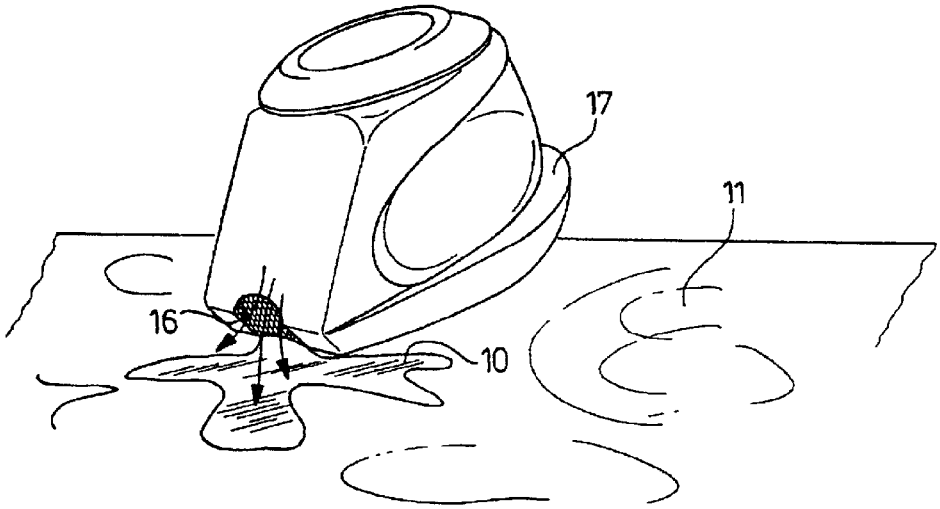
FIG. 4 is a perspective view of the hand-held container of FIG. 1 during the second step of the process of the invention.
Figure 5:
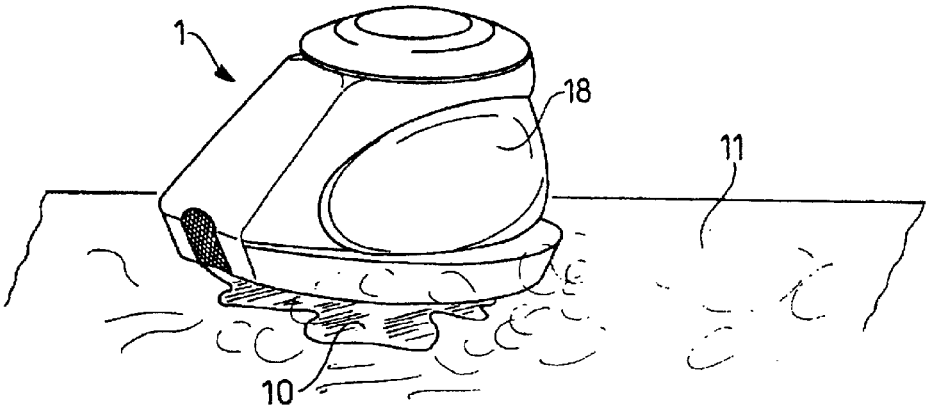
FIG. 5 is a perspective view of the hand-held container of FIG. 1 during the second step of the process of the invention.

Once insertion of the detergent composition and of the water has occurred, the embodiment of FIG. 1 may be used as described in FIGS. 4 and 5, whereby the implement 1 is scrubbed over the surface 11 to be treated. In these Figures, for reasons of clarity, the hand of the user is not drawn, although it is it which is acting onto the device 1. The mixture 10 is applied onto the surface 11 through the second filling opening 16 which in this example can also serve as a dispensing opening 16. It should be noted that this opening 16 is formed from a net like structure which allows control of the mixture 10 dispensed by filtering. This is particularly useful when the first product 2 is in a granular form, whereby the filter allows to avoid direct dispensing of non-dissolved granules onto the surface 11. Indeed, as is the case when using detergent granules, such granules are most efficient when applied once dissolved. Another particular feature of the embodiment of the device 1 of the invention as illustrated on FIG. 4 in that the dispensing opening 16 is inclined at an angle. This is made in order to avoid clogging of the filter. Indeed, it should be reminded that this device 1 may be used without the membrane 122, in which case, when using granules for example, clogging may occur, thus hindering application of the mixture. This is avoided by giving an inclination to the dispensing opening 16. Once part of the mixture 10 is on the surface 11, the friction means 13 provided on the outer surface of the base 14 of the container 1 is used for further applying the mixture 10 onto the surface 11. It is important that the friction means 13 is on the outer surface of the base 14 of the container 1 in order to allow active friction. Indeed, the user can press firmly onto the device 1 in a direction normal to the base 14 in order to have a more active friction, this being allowed by the fact that the device 1 lie on its base 14 in a stable manner. There is another particular feature in this embodiment which allows active and firm action on the surface 11 which consists in a platform 17 provided for pressing for example the tip of the fingers in order to exert a greater force in the direction normal to the base. Such a platform 17 also serves as a protecting means for the hand of the user by physically avoiding direct contact between the hand or fingers of the user with the mixture 10 and/or the area of application.

Figure 6:
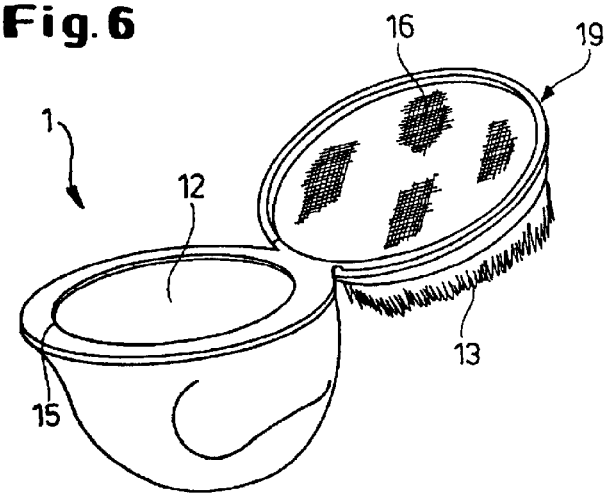
FIG. 6 is a cross section of another embodiment of the hand-held container according to the invention.

In another version of a hand-held container or device according to the invention presented in FIG. 6, the friction means 13 is a porous friction means which can act both as a friction means 13 and for applying the mixture 10 onto the surface 11. In such a case, the second opening 16 as described in the embodiment of FIGS. 1 to 5 and serving for application of the mixture 10 by means of an inclined filter may be suppressed. Indeed, porous friction means 13 will also allow insertion of a product as well as the second opening 16 could allow in the embodiment of FIGS. 1 to 5. Furthermore, such porous friction means 13 can allow replenishment of the water 3, for example. Indeed, if for example, the surface 11 to be treated is such that the water 3 has been directly applied to the surface 11, and if the dispensing device 1 has flexible resilient walls 18 allowing to exert a mechanical action, the flexible walls 18 may be repeatedly compressed in order to create a depression in the device 1. Such a depression will be usually followed by a sucking action at the level of the porous friction means 13 such that some of the water 3 on the surface 11 will be inserted in the mixing volume 10. This will induce replenishment of the water 3 during use. In this case, whereby the water 3 is inserted in the mixing volume 12 during application of the mixture 10, the ratio of the mass of the detergent product 2 comprised in the mixing volume 12 to the mass of the water 3 comprised in the mixing volume 12 is varying. As there is some of the detergent composition 2 and some of the water 3 in the mixing volume 12, such a ratio is defined. Indeed, this ratio could not be defined if there was none of the water 3 in the mixing volume. Replenishment may also take place if the device 1 is dipped within the water 3 during application as in FIG. 3. The advantage of replenishment is that it allows to control the relative quantities of the detergent composition 2 and of the water 3 within the mixture 10.

In case of use of flexible resilient walls 18, there are various advantages. Indeed, such walls 18 can be suitable for adapting to the shape of a hand or to the relief of the surface 11. Furthermore, such walls 18 may be used as explained above for sucking in a product such as water. Such a function is facilitated if the only opened opening is for example the porous friction means 13. Therefore, in case of use of a device 1 as presented in FIGS. 6 to 10 provided with a porous friction means 13 instead of a second opening 16, it is preferred to close the first opening 15 with a lid 19 if it is desired to use flexible resilient walls 18 for sucking in a product. However, closure could also simply be made by applying the palm of a hand onto the opening 15, if the device 1 has a design similar to the design of the embodiment of FIGS. 1 to 5. Indeed, the palm of the hand is intended to be placed in this location. Yet another possibility is that the first opening 15 is situated on the base 14 of the device 1 as in FIGS. 6 to 10, so that it can be repeatedly and removably covered with the friction means 13. Such removability can be provided by using clipping means, threads or a hinge such that the opening can be used for inserting product, and then reclosed using the removable or hinged friction means. Such an embodiment could also look similar to the embodiment presented in FIGS. 1 to 5, whereby it would not have the first 15 nor the second 16 opening as in FIGS. 1 to 5, and therefore no lid 19, but whereby the base 14 could be opened up to give access to the volume 12 for the content of the container 1. However, in order to facilitate the manufacturing process of the device 1, it would be preferable that the friction means 13 be an integral part of the device 1, so that the whole device 1 is only one piece. Reclosability could still be achieved for example by moulding the device 1 with friction means 13 as an integral part attached to the main part by a flexible hinge. Indeed, such a device 1 would preferably be manufactured using thermoplastic resins, preferably poly-olefins, being made using for example Ziegler Natta or Metallocene catalysis. Preferred poly-olefins would include poly-ethylene or poly-propylene resins. Thermoplastic elastomers, rubbers or thermoset resins may also be used. The device or hand-held container 1 could be made transparent or see-through to allow the user to check a level or to check dissolution, for example. The device 1 could also be provided with dosing lines. Other features could include specific moulding of the device so as to facilitate grip by the user.

Another advantage which could be provided by flexible resilient walls 18 would be to allow to exert a mechanical action on the content of the container 1. This would be particularly suited when the detergent composition is not liquid. For example, if the detergent composition 2 is in the form of a tablet or of granules, mechanical action through flexible resilient walls 18 will significantly improve dissolution of the detergent composition 2. This is particularly useful when using such a detergent composition for hand washing, as it allows to suitably control the concentration of the mixture dispensed. This is particularly useful when using particular detergent compositions which dissolve slowly, therefore allowing to use smaller amounts of water during the washing than would normally be needed for a satisfactory dissolution. Indeed, the device could be provided with mechanical means for improving or accelerating or allowing pre-dissolution of a non liquid composition such as a tablet or such as granules in a solvent such as water. Furthermore, in case of use with a tablet, and more specifically with a detergent tablet, the device could allow crushing of the tablet prior to use by inserting the tablet within the device by itself or with a second product, such crushing favouring dissolution of the tablet. This would be particularly useful if applied to detergent tablets such as disclosed in the pending European applications of the Applicant n° 96203471.6, 96203462.5, 96203473.2 or 96203464.1. In such a case, mechanical action on the tablet prior to use or during use will allow to improve dissolution and therefore effectiveness in hand laundry washing. Tablets are preferably blocks of product having a given cross section, and having a shape defined by a translation along a distance corresponding to the thickness of the tablet of this given cross-section. More preferably the cross section is rectangular, square, with or without rounded corners or chamfer. Most preferably, the cross section is elliptical or circular, therefore making it a cylinder. The shape of the volume of the device could be more specifically designed so as to take account of the shape of such tablets while facilitating application of the mechanical action through for example the resilient walls and allowing dissolution and dispensing of a mixture.

Figure 7:
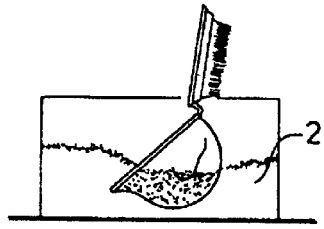
FIG. 7 is a perspective view of the hand-held container of FIG. 6 during the first step of the process of the invention.
Figure 8:
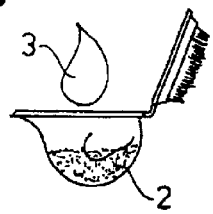
FIG. 8 is a perspective view of the hand-held container of FIG. 6 during the first step of the process of the invention.
Figure 9:
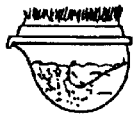
FIG. 9 is a perspective view of the hand-held container of FIG. 6 during the first step of the process of the invention.
Figure 10:
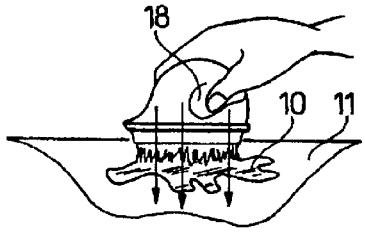
FIG. 10 is a perspective view of the hand-held container of FIG. 6 during the second step of the process of the invention.

Relating to the embodiment presented in FIGS. 6 to 10, it should be noted that it is provided with means for scooping product as it has the shape of a scoop as appears in FIG. 7 whereby the first product, the detergent composition 2, in this example granules, is being inserted as in the process according to the invention. In FIG. 8, the second product, water 3, is being inserted within the volume 12. In this particular example, insertion of the second product, water 3, is made directly and through the same opening than insertion of the first product, detergent composition 2. However, the second product 3 could also be inserted through porous friction means 13. It should be noted that the volume 12 in the embodiment presented in FIGS. 6 to 10 is a hollow body having a single medium, to the difference of the embodiment presented in FIGS. 1 to 5. In this embodiment, dissolution of the first product 2, i.e. the granules, in the second product 3, i.e. the solvent inserted as shown in FIG. 8, could be improved by shaking the closed device 1 as in FIG. 9 so as to improve dissolution by mechanical means particularly consisting in shaking in this example. The embodiment presented in FIGS. 6 to 10 has a reclosable lid 19 for the filling opening 15, whereby the lid 19 serves also as a base 14 and therefore caries the friction means 13 on the outer surface of the base 14. In this example, the friction means 13 is composed of a plurality of hair like parts. Such parts can either be made separately and clipped onto the device, or the device may be a one piece device comprising the friction means as an integral part, thus allowing a manufacture in one piece. The friction means has a length in one direction of at least 4 cm. This allows to use the device 1 for hand use in a particularly efficient manner when using the friction means 13 along a direction perpendicular to the direction where the friction means 13 are of at least 4 cm. In the embodiments presented in FIGS. 1 to 13, the friction means 13 are covering a surface, in particular a substantially circular surface in case of the embodiment presented in FIG. 6, the surface being such that it comprises a full length of 4 cm of friction means 13 in at least one direction. For example, friction means 13 corresponding to a surface and more particularly to a circular surface and having a diameter of 4 cm would be convenient, particularly because it is efficient for use in all directions. However, it is also possible to use a linear friction means as long as such a friction means has a length of at least 4 cm along one direction. It should be noted that such friction means 13 could be such that it would allow more or less rough friction when used along one or another direction. Indeed, the friction means could be such that they are particularly flexible along a first direction, thus convenient for treatment of a delicate surface, or less flexible along another direction, thus allowing treatment of less delicate surfaces or of surfaces requiring a more intense treatment. Such friction means 13 could have for example a hair like structure with a given or variable resilience and flexibility, or a net like structure such as used for example on some sponges for scrubbing dishes, or a roughened or spiky surface, as long as it allows friction between the surface and the friction means. Other examples include protruding fibres, or abrasive or non-abrasive fabric, woven or non woven, brush material or dimpled material to provide high pressure points. This includes a membrane such as a polyethylene, polypropylene, polyethylene therephthalate or styrene membrane having penetrating or non penetrating bristles placed on one side in a direction normal to the membrane. Ideally, the friction means should provide effective scrubbing despite non-flat surfaces to treat. Indeed, the surface to treat may not be flat. Furthermore, it may be useful if the friction means provides some degree of penetration within the dimension of the surface, particularly as this surface is fabric. Friction could be rendered more or less gentle depending on the force applied to the device. It is preferred that the device has means 17 for applying a force by hand in the direction normal to the base 14 for this purpose. Such means for applying a force may consist in a relatively rigid structure or platform 17 on which the hand can press, or may consist of a handle like structure, for example. It should be noted that the force exerted on the device 1 for friction purpose also may have components both in a direction normal to the base 14 and in a direction in the plane of the base 14 in the direction defining the trajectory of the device. It should be noted that in a preferred embodiment, the friction means is designed so as to avoid inherent directionality.

Preferably, the friction means 13 will have a length along at least one direction of at least 4.5 cm, more preferably of at least 5.25 cm, even more preferably of at least 6.25 cm and most preferably of at least 7 cm. As a further characteristic, the friction means should preferably cover a surface of at least 10 $cm^2$, more preferably of at least 15 $cm^2$, even more preferably of at least 25 $cm^2$ and most preferably of at least 40 $cm^2$.

In the embodiments presented in FIGS. 1 to 10, the first product, detergent composition 2, is granules. However, same applies for gel, paste, liquid or other flowing materials, whereby dissolution may also be improved by mechanical means, for example by shaking. Similarly, the second product, water 3, may also and independently have various forms including liquid, gel, paste or granules.

Figure 11:
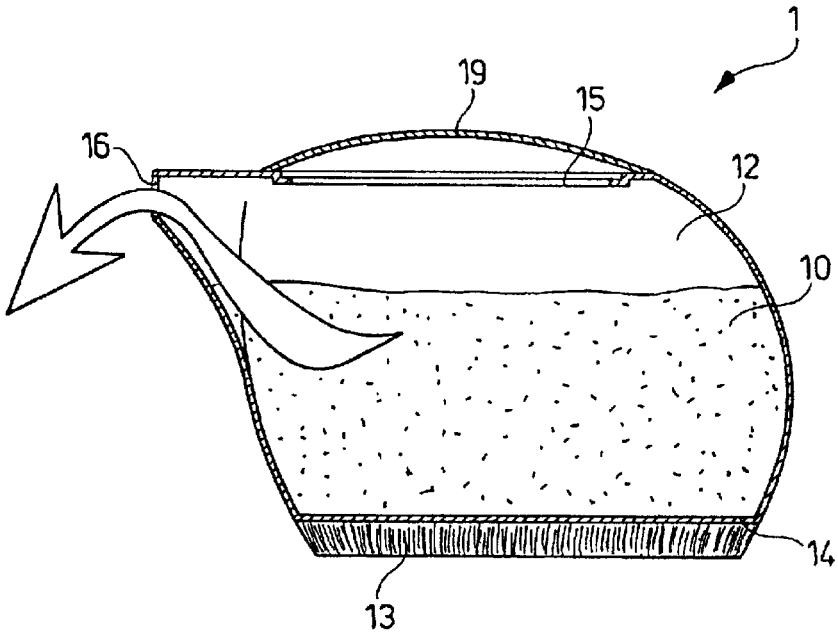
FIG. 11 is a cross section of yet another embodiment of the hand-held container according to the invention.

In the embodiment presented on FIGS. 11 to 13, insertion of the products, detergent composition and water, can occur through a filling opening 15 situated on the side of the device or hand-held container 1 opposite to the base 14, whereby the opening 15 can subsequently be closed either by a lid 19, as on FIG. 11, or by the palm of a hand during use for example. Other reclosable openings include use of a resilient "purse like" opening whereby application of a force at both ends of a resilient structure will open it, or resilient openings similar to openings as described in WO94/29182 for snap caps. It should be noted that filling can be made using unit dose pouches for example. The friction means 13 is placed on the outer surface of the base 14 according to the invention, and application of the mixture 10 can occur through a pouring spout provided on the side of the device or hand-held container opposite to the base. It should be noted that such a structure will allow to apply the mixture 10 only if the device 1 is tilted. Indeed, in this particular element, neither the friction means 13 nor the base 14 are porous. This allows a good control on the amount of mixture 10 to be applied. Indeed, the user will pour and therefore apply mixture 10 to the surface 11 only when desired, by tilting the device 1. In a preferred embodiment, the dispensing means allowing to apply the mixture onto the surface comprise a valve or more preferably a self seal valve. Other means for dispensing the mixture include use of a dip tube dipping on the one side into the mixture, and reaching out of the device, preferably at an angle, so as to direct a jet of mixture onto the surface on which the mixture should be applied, when the device is squeezed, for example. Such a dip tube may be advantageously combined with a self-seal valve, the self-seal valve contributing by a pressure build-up allowing the mixture to travel up in the tube.

Figure 12:
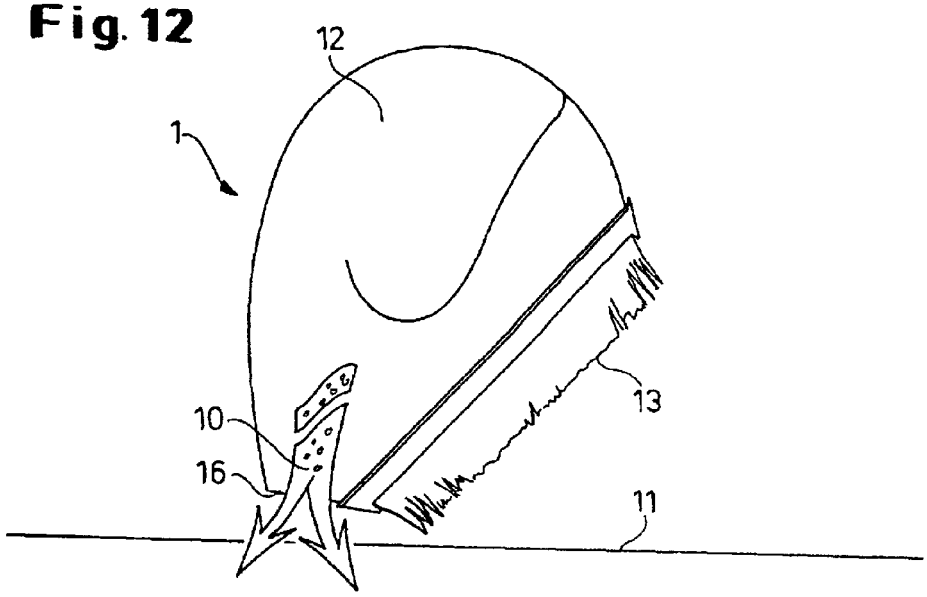
FIG. 12 is a perspective view of the hand-held container of FIG. 11 during the second step of the process of the invention.
Figure 13:
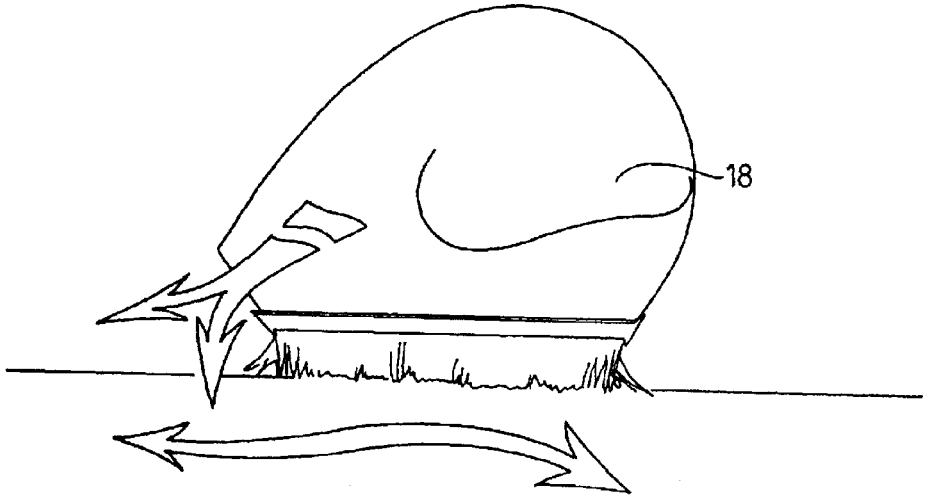
FIG. 13 is a perspective view of the hand-held container of FIG. 11 during the second step of the process of the invention.

This control by tilting is also possible on the device presented on FIGS. 12 and 13, whereby the angle of the opening 16 allowing application of the mixture is such that more mixture will be dispensed when the device 1 is tilted. Indeed, when mathematically projecting the surface of the opening 16 onto the surface 11 to be treated along a direction normal to the surface 11 to be treated, the projected surface of the opening 16 is larger when the device is tilted, so that more of the mixture 10 is dispensed in this manner. In this particular example, the opening 16 can serve as a filling opening as well as means for distribution of the content.

The devices or hand-held containers according to the invention as for example presented in FIGS. 1 to 13 preferably have a shape which is substantially convex. By convex it should be understood that it bulges toward any external point of observation, this in order to facilitate handling by a user. Therefore, the preferred shape for such a device would substantially be a sphere, an ellipsoid or an ovoid. As the device according to the invention has a base for supporting the friction means, it preferably also comprises a flat part. However, such a part should introduce a minimum of concave surfaces, and if possible none. The ideal convex shape may also be slightly modified to accommodate handling by hand, while also introducing a minimum of concave surfaces. The cross section or contour of the friction means are preferably designed to insure fabric protection during scrubbing, optimise the scrubbing effect, and maximise robustness of the friction means against wear, this being preferably achieved in a semi-circular or partially elliptical cross-section along any plane substantially perpendicular to the base. Furthermore, the device should be such that it could be readily emptied out from its content during use. This means that the mixing volume containing the content should preferably not comprise dead ends or shapes in which the content could be caught and would therefore not be used. Similarly, un-maintained and soft materials would tend to facilitate clogging and thus to hinder efficient dispensing. By un-maintained, it is meant that it can substantially freely collapse, thus retaining mixture in collapsed parts. In case of a presence of a membrane as in the embodiment presented in FIGS. 1 to 5, the membrane may be removable to facilitate this purpose. In order to be readily emptied, the device also comprises means for distribution of the content.

As a further characteristic, the device according to the invention may comprise means for dispensing the mixture whereby such means facilitate sudsing, foaming or bubbling. This may be achieved by having dispensing means consisting in a porous surface, the surface having a plurality of openings for providing the porosity, whereby the percent open surface area of such a surface is comprised between 20 and 60%.

In another preferred embodiment, a pair of such devices is used, the base of the first device being placed against the base of the second device for efficiently scrubbing a surface placed in between the bases. Such a pair of devices may also conveniently comprise means for mutually co-operating so as to use it as one device having two friction means by joining the first and second base in the same plane, the two devices being side to side.

Another convenient embodiment would comprise inserting the device within a flexible pouch having a rigid frame for catching the surface to be treated, so that the surface would be maintained when using the device. Such a pouch could co-operate with the device in such a manner that the device will be fixed to the pouch.

In a preferred aspect according to the invention, concerning a hand-held container having a base at one end, the friction means being on the outer surface of the base, the hand-held container further comprises a force application area, the force application area making an angle of less than 90° and of more than 20° with the base, the angle between the force application area and the base changing of less than 50% when a pressure of 50 kPa is applied onto the force application area, the means for distribution of the content being actuated by a pressure of at least 30 kPa, it was found that such a device would be particularly suitable for heavy hand use, for example for washing laundry. Indeed, the angle between the base and the force application area is such that it adapts well to heavy hand washing, allowing the user to apply a strong mechanical action while being in a natural position. Indeed, the palm of the hand would typically lie onto the force application area during use. Furthermore, the fact that the angle between the force application area and the base changing of less than 50% when a pressure of 50 kPa is applied onto the force application area gives rigidity to the force application area which allows good transfer of mechanical forces between the palm of the hand and the base. Typically, the force application area has the shape that accommodates the palm of a hand. A further feature is that the means for distribution of the content being actuated by a pressure of at least 30 kPa. This allows actuation by application of a force using a finger, typically. It should be noted that in this manner, the content is dispensed only when so desired by the user. Preferably, the actuation means is situated on the side of the device opposite to the force application area, so that the user would have its finger placed in the region of the actuation means when its palm is against the force application area. Actuation means could consist in walls sufficiently resilient to allow exerting a mechanical action allowing to expel product. In another embodiment, actuation means consist of a valve. It may also consist of a button. Preferably, the means for distribution of the content is such that the content is distributed directly towards the surface, further facilitating use for heavy wash. This is most preferably combined with actuation on the side of the device opposite to the base, i.e. on the top of the device.

In a preferred embodiment, the angle between the force application area and the base is of at least 25°, more preferably of at least 30° and most preferably of at least 35°. Preferably, this angle is of less than 70°, more preferably of less than 50° and most preferably of less than 40°. This angle is measured when no force is applied onto the force application area, and can be measured for example by measuring the angle formed between the edge of the base and the edge of the force application area in a cross section along a plane normal to the base, the plane preferably comprising the direction of use of the device, i.e. the plane being preferably normal to both the base and the force application area.

When a pressure of 50 kPa is applied onto the force application area, the angle between the force application area and the base changing of less than 50%, preferably of less than 40%, more preferably of less than 30% and most preferably of less than 20%. It should be noted that the change is normally corresponding to a reduction of the angle, for example, a change of 50% bringing an angle of 70° to 35°. This relative rigidity is such that the user can repeatedly use the device and apply force onto the force application area without collapsing of the device, while maintaining comfort of use, as such a device is mainly intended to be used heavily.

The means for distribution of the content is actuated by a pressure of at least 30 kPa, preferably by a pressure of at least 40 kPa and most preferably by a pressure of at least 45 kPa, and preferably by a pressure of less than 100 kPa, more preferably of less than 80 kPa and most preferably of less than 55 kPa. Such an actuation pressure being aimed at allowing easy actuation during use, typically with one or more fingers or by a squeezing action, preferably while the user is applying a force onto the force application area, typically with the palm of the hand.

In a preferred embodiment, the mixing volume is of at least 25 $cm^3$, more preferably of at least 35 $cm^3$, even more preferably of at least 45 $cm^3$ and most preferably of at least 55 $cm^3$.

What is claimed is:

1. A process for washing laundry using a hand-held container having a mixing volume, friction means and dispensing means, the process comprising a first step of preparing a mixture by inserting a detergent composition and water in the mixing volume, a second step of cleaning the laundry by dispensing at least part of the mixture onto the laundry and by scrubbing the laundry with the friction means, wherein the second step is directly followed by a rinsing step.

2. The process according to claim 1 wherein the detergent composition is a granular product.

3. The hand-held container according to claim 1 wherein the friction means has a length along one direction of at least 4 cm.

4. The hand-held container according to claim 1 wherein the hand-held container has a base at one end, the friction means being on the outer surface of the base, and the container further comprises a force application area, the force application area making an angle of less than 90° and of more than 20° with the base, the angle between the force application area and the base changing less than 50% when a pressure of 50 kPa is applied onto the force application area.

5. The hand-held container according to claim 1 wherein the dispensing means is actuated by a pressure of at least 30 kPa.

6. The hand-held container according to claim 1 further comprising flexible resilient walls for exerting a mechanical action on the contents.

7. A kit comprising a hand-held container and instructions, the hand-held container having a mixing volume, friction means and dispensing means, and the instructions describe a process for washing laundry using the hand-held container, the process comprising a first step of preparing a mixture by inserting a detergent composition and water in the mixing volume and a second step of cleaning the laundry by dispensing at least part of the mixture onto the laundry and by scrubbing the laundry with the friction means.

8. The kit according to claim 7 wherein the second step of the process is directly followed by a rinsing step.

9. A kit comprising a hand-held container and a washboard, the hand-held container having a mixing volume, friction means and dispensing means.

10. A process of using the kit of claim 9 wherein the process comprises a first step of preparing a mixture by inserting a detergent composition and water in the mixing volume and a second step of cleaning the laundry by dispensing at least part of the mixture onto the laundry and by scrubbing the laundry with the friction means, the laundry being placed between the hand-held container and the washboard.

* * * * *

UNITED STATES PATENT AND TRADEMARK OFFICE

CERTIFICATE OF CORRECTION

PATENT NO. : 6,874,190 B2
DATED : April 5, 2005
INVENTOR(S) : Joseph Fernand Deflander et al.

It is certified that error appears in the above-identified patent and that said Letters Patent is hereby corrected as shown below:

Title page,
Insert Item -- [30] Foreign Application Priority Data
PCT/US00/20344 dated July 26, 2000 --.

Signed and Sealed this

Thirtieth Day of August, 2005

JON W. DUDAS
*Director of the United States Patent and Trademark Office*